US006715661B2

(12) United States Patent
Klein

(10) Patent No.: US 6,715,661 B2
(45) Date of Patent: Apr. 6, 2004

(54) INSTALLATION FOR SHAPING A PART AND APPLICATION TO HOT FORMING

(75) Inventor: Gilles Klein, Mery S/Oise (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 10/053,547

(22) Filed: Jan. 24, 2002

(65) Prior Publication Data

US 2002/0100303 A1 Aug. 1, 2002

(30) Foreign Application Priority Data

Feb. 1, 2001 (FR) ..... 01 01351

(51) Int. Cl.[7] ..... B22D 41/015; B23K 37/00

(52) U.S. Cl. ..... 228/44.3; 228/51; 425/406; 164/338.1

(58) Field of Search ..... 228/19, 44.3, 51, 228/141.1, 187, 190, 219, 220; 425/73, 406–423, 451; 164/338.1; 72/38, 448

(56) References Cited

U.S. PATENT DOCUMENTS 3,893,318 A * 7/1975 King et al. ..... 72/38
3,945,230 A * 3/1976 Tomioka et al. ..... 483/1
4,510,363 A 4/1985 Reynolds, Jr.
4,601,422 A 7/1986 Dumargue et al.
4,720,615 A * 1/1988 Dunn ..... 219/651
5,027,635 A * 7/1991 Wilks ..... 72/342.7
5,325,694 A * 7/1994 Jenista ..... 72/13.3
5,544,805 A * 8/1996 Alassoeur et al. ..... 228/190
5,567,381 A * 10/1996 Carter ..... 266/250
5,826,332 A * 10/1998 Bichon et al. ..... 29/889.72
5,843,366 A * 12/1998 Shuert ..... 264/545
5,896,658 A * 4/1999 Calle et al. ..... 29/889.72
5,933,951 A 8/1999 Bergue et al.
5,946,802 A * 9/1999 Calle et al. ..... 29/889.721
6,000,322 A * 12/1999 To ..... 100/35
6,015,512 A * 1/2000 Yang et al. ..... 264/2.2
6,210,630 B1 * 4/2001 Bergue et al. ..... 266/96
6,446,478 B1 * 9/2002 Muller ..... 72/306
6,463,779 B1 * 10/2002 Terziakin ..... 72/342.96

* cited by examiner

*Primary Examiner*—Tom Dunn
*Assistant Examiner*—Colleen P. Cooke
(74) *Attorney, Agent, or Firm*—Oblon, Spivak, McClelland, Maier & Neustadt, P.C.

(57) ABSTRACT

While one preform (A) is being shaped between two dies (4, 11), another preform (B) is being prepared by heating in a compartment (14) on a lower die (5) similar to the preceding one (4). When the preform (A) has been shaped, a mobile section (3) of the furnace is lifted to release the upper die (11) and make it possible to place the new preform (B) and its lower die (5) beneath it. Thus, when one preform has been shaped, the following one is already prepared by heating.

5 Claims, 2 Drawing Sheets

Figure 1:
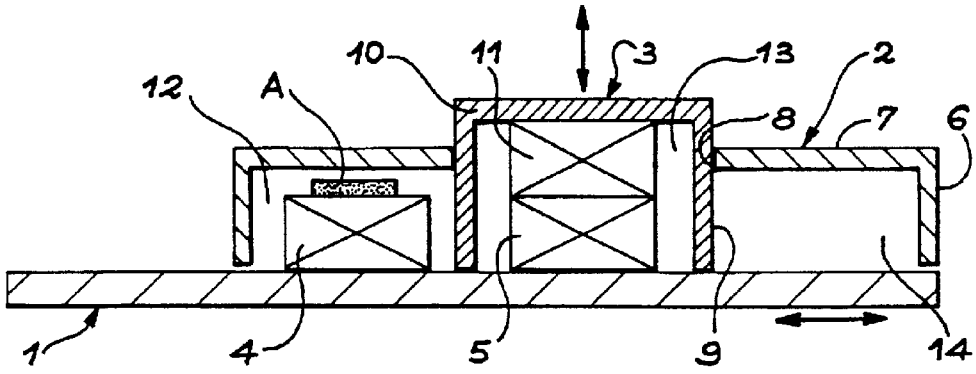

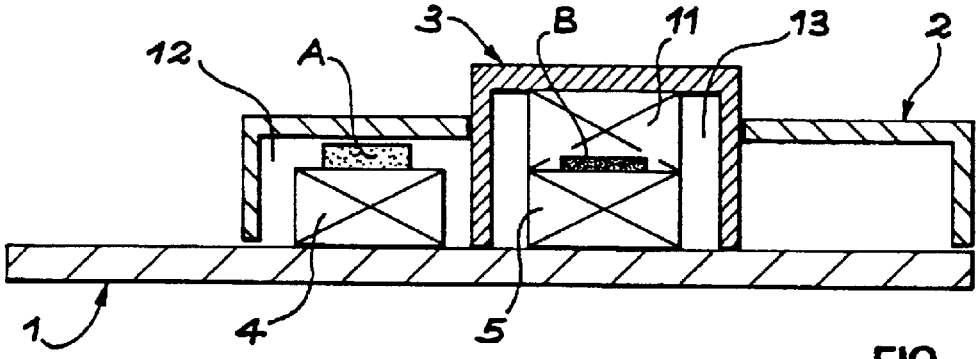
FIG. 4
FIG. 5
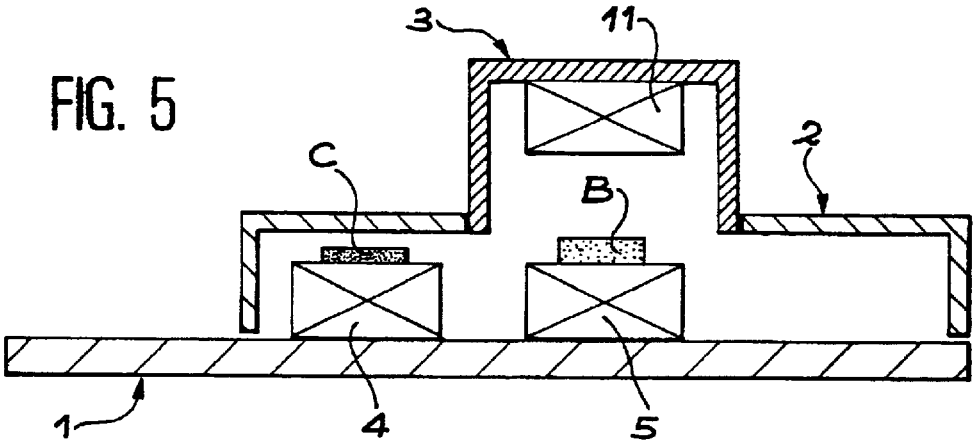
FIG. 6
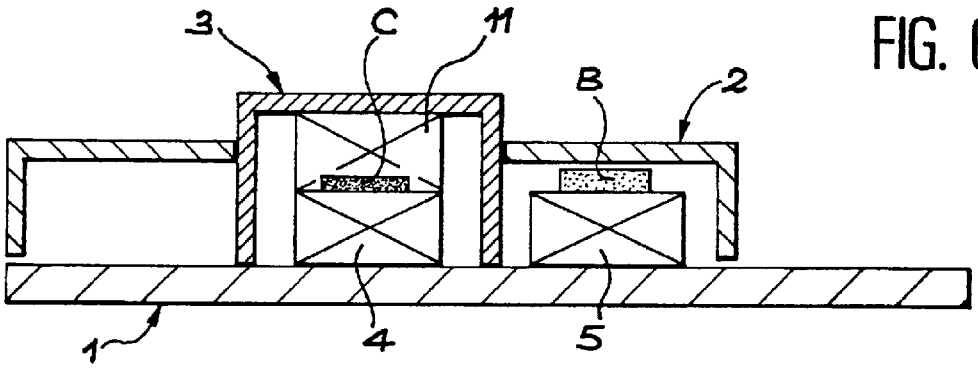

INSTALLATION FOR SHAPING A PART AND APPLICATION TO HOT FORMING

The present invention relates to an installation for shaping a part, which can be applied to hot forming methods.

Hot forming methods are used for certain parts such as the hollow fan blades of a turbo-reactor, which are shaped from an assembly of three sheets of titanium, two of which constitute the skins of the blades whilst the third, intermediate, is worked into stiffeners which extend from one skin to the other in a cavity formed between them. The manufacture of these parts requires a hot diffusion bonding operation to unite the sheets at the leading and trailing edges, then the bulging of the internal cavity, still at high temperature, by progressive introduction of a gas such as argon or helium. This is carried out in specific presses comprising a lower die and an upper die which can be joined together to contain the preforms of the blades and to profile their shape. The dies are enclosed in a furnace and brought to the required temperature. The shaping time for the parts is several hours and, apart from the shaping stage, comprises fairly long stages for loading the preforms and placing them in the right position on the lower die, for re-heating the dies and the preforms each time the furnace is opened, and finally for extracting the shaped parts from the furnace. Reference can be made to the document EP-A-0 765 711 for a complete description of the manufacture of such hollow blades.

The aim of the invention is to raise the production rate of parts without having to multiply the number of shaping installations. To resume, the furnace is divided by an insulating wall into at least two compartments making it possible to carry out the operation of shaping one part in one of the compartments while another part is being introduced into the other and set to heat, or is extracted from it. Thus, one element of the operations linked to the shaping is carried out in concurrent operation time in a series production procedure.

The shaping installation is more precisely characterised in that the furnace comprises two superposed parts, with one upper carrying part for the upper die and a lower part, carrying two examples of the lower die present in respective compartments, the upper part being mobile relative to the lower part in such a way that the upper die covers the examples of the lower die alternately, a dividing wall separating the compartments.

In a preferred embodiment of the invention, the furnace is defined by a horizontally mobile plate carrying the examples of the lower die, a fixed wall comprising a lateral boundary and a roof, together with a vertically mobile wall, carrying the upper die and comprising a lateral boundary, connected through a drilling in the roof of the fixed wall and comprising the dividing wall, plus a roof.

The invention will now be described in detail and will be better understood through reference to FIGS. 1, 2, 3, 4, 5 and 6 which show the main stages of a manufacturing process produced by means of the installation according to the invention, and the installation itself.

The complete installation can be seen in FIG. 1. It comprises a lower plate 1, a fixed wall 2 and a mobile wall 3, which all three define a heating volume of a furnace chamber. The plate 1 carries two lower dies 4 and 5 placed close to each other and of similar shape for housing the preforms of the blades to be shaped. The fixed wall 2 comprises a lateral boundary 6 whose lower edge goes down to the plate 1, and a roof 7 drilled with a hole 8; finally, the mobile wall 3 comprises a boundary 9 connected through the drilling 8 and a roof 10 to which an upper die 11, complementary to the lower dies 4 or 5, by creating with one or the other of them a shaping cavity for a blade preform, is attached to this roof 10. The means necessary for making the plate 1 slide horizontally and the mobile wall 3 slide vertically are the usual means and are not shown.

The volume of the furnace enclosed by the plate 1 and the walls 2 and 3 is divided into adjacent compartments, at least two in number (three in this embodiment) and with respective references 12, 13 and 14. The central compartment 13 is inside the wall 9 and contains the upper die 11 and, at present, the second lower die 5; the left-hand compartment 12 contains the first lower die 4; the right-hand compartment 14 is empty, at present. Doors, not shown, are pierced through the boundary 6 to provide access to the left and right compartments 12 and 14. Openings are made in the boundary 9 of the central compartment to provide access to the lower dies 4, 5, and the upper die 11.

Figure 2:
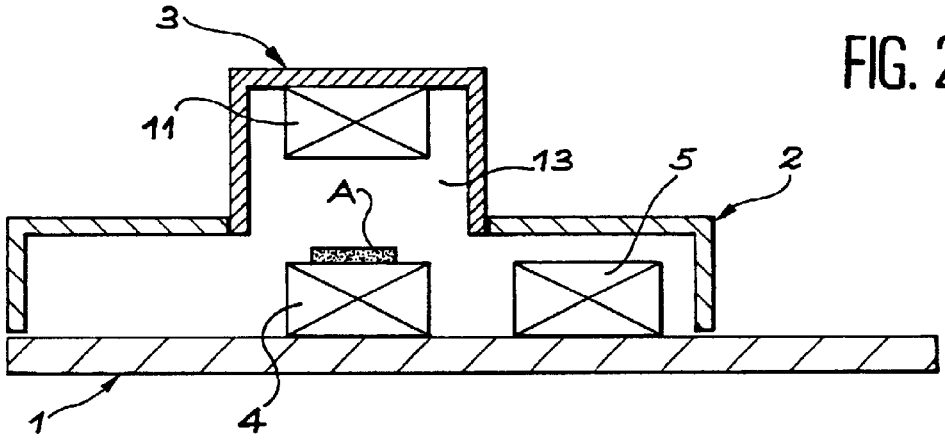
Figure 3:
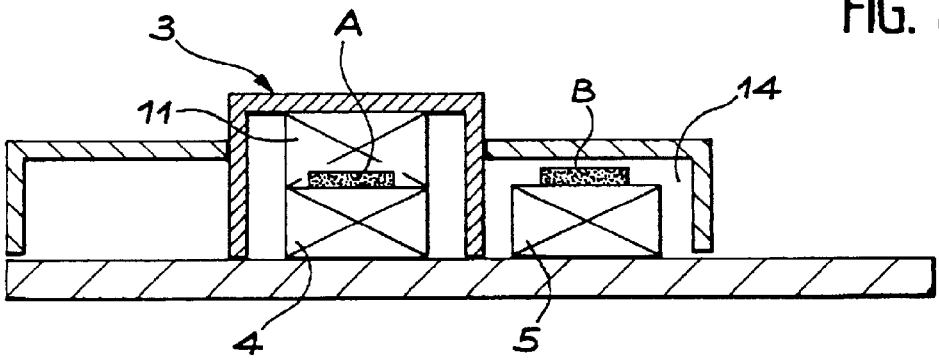

In order to start up the process, a preform A is set on the first lower die 4 and submitted to heating after the furnace has been re-closed, and when the preform A and the lower die 4 have reached the shaping temperature, the mobile wall 3 is lifted, and then the plate 1 is moved to the right until the first die 4 has entered the central compartment 13 and arrives beneath the upper die 11; this state is shown in FIG. 2. The following operation consists of lowering the mobile wall 3 to join the upper die 11 to the first lower die 4 and to re-close the cavity in which the preform A can be shaped. During this time, a second preform B is introduced into the right-hand compartment 14 and set on the second lower die 5, now in this compartment, where it is left to heat; this state is shown in FIG. 3.

When the preform A has been shaped, the mobile wall 3 is lifted and the plate 1 is returned towards the left, which brings the first lower die 4, on which the first preform A remains in position, into the left compartment 12 while at the same time introducing the second preform B into the central compartment 13. Then the mobile wall 3 is lowered again so that the upper die re-closes, this time with the second lower die 5, the shaping cavity of the second preform B; this state can be seen in FIG. 4.

The first preform A is then extracted and replaced by a third preform C waiting in the left-hand compartment 12 until it has been heated and the second preform B has been shaped. Then the stages already described are repeated for lifting the mobile wall 3 (the state shown in FIG. 5) for moving the plate 1 towards the right to place the third preform C beneath the upper die 11 and lowering the mobile wall 3 to re-close a shaping cavity for the third preform C, while rejecting the second preform B into the right-hand compartment 14; the resulting state is shown in FIG. 6, and the process continues by extracting the second preform B and replacing it by a new one which will be left to heat up during the shaping of the third preform C. This process continues, always in the same way: two consecutive preforms will be treated at the same time, one being shaped in the central compartment 13 while another will be prepared in one of the lateral compartments on the left 12 or on the right 14, which will increase the rate of production substantially.

It is possible to replace the to-and-fro movement of the plate 1, which requires three compartments being made, by a rotational movement inverting the positions of the lower dies 4 and 5, which does not need more than two furnace compartments. Other improvements to the embodiment envisaged these days can also be included without going beyond the domain of the invention.

What is claimed is:

1. An installation for shaping a part between upper and lower dies, comprising:

an enclosure defining a furnace, wherein the enclosure comprises:

a dividing wall separating two or more compartments inside the enclosure;

a lower part carrying two or more lower dies; and an upper part carrying an upper die, said upper and lower dies being respectively located in the compartments, the lower part and the upper part being mobile relative to each other such that the upper die alternatively covers each of the two or more lower dies.

2. An installation according to claim 1, wherein the enclosure further comprises:

a stationary part having a lateral wall and a roof, wherein the upper part of the enclosure comprises the dividing wall and the roof, the lower part of the enclosure comprises a plate, and the lower part is configured to slide under the lateral wall horizontally and the upper part is configured to slide through the roof of the stationary part vertically.

3. Application of the installation according to claim 1 to hot forming of parts including a cavity submitted to bulging during shaping.

4. Application of the installation according to claim 2 to hot forming of parts including a cavity submitted to bulging during shaping.

5. An installation according to claim 2, wherein the dividing wall separates three compartments inside the enclosure, the upper die being in a central compartment of the three compartments.

* * * * *